US012638247B2

(12) United States Patent
Wang et al.

(10) Patent No.: US 12,638,247 B2
(45) Date of Patent: May 26, 2026

(54) VAPOR CHAMBER STRUCTURE AND MANUFACTURING METHOD THEREOF

(71) Applicant: Unimicron Technology Corp., Taoyuan City (TW)

(72) Inventors: Chin-Sheng Wang, Taoyuan City (TW); Ra-Min Tain, Hsinchu County (TW)

(73) Assignee: Unimicron Technology Corp., Taoyuan City (TW)

( * ) Notice: Subject to any disclaimer, the term of this patent is extended or adjusted under 35 U.S.C. 154(b) by 355 days.

(21) Appl. No.: 18/418,349

(22) Filed: Jan. 22, 2024

(65) Prior Publication Data

US 2024/0159473 A1 May 16, 2024

Related U.S. Application Data

(60) Continuation-in-part of application No. 17/983,396, filed on Nov. 9, 2022, now abandoned, which is a (Continued)

(30) Foreign Application Priority Data

| | | |
|---|---|---|
| Jul. 14, 2020 | (TW) | 109123680 |
| Nov. 9, 2020 | (TW) | 109138973 |
| Nov. 7, 2023 | (TW) | 112142742 |

(51) Int. Cl.
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC ... F28F 21/081; F28F 3/10; F28F 3/14; F28D 15/0233; F28D 15/0283
See application file for complete search history.

(56) References Cited

U.S. PATENT DOCUMENTS

2012/0168435 A1 7/2012 Chen et al.
2014/0014304 A1* 1/2014 Chin ..... F28D 15/046 29/890.032

(Continued)

FOREIGN PATENT DOCUMENTS

CN 104754926 7/2015
TW 202037871 10/2020

(Continued)

OTHER PUBLICATIONS

"Office Action of Taiwan Counterpart Application", issued on Aug. 2, 2024, pp. 1-8.

*Primary Examiner* — Jianying C Atkisson
*Assistant Examiner* — Khaled Ahmed Ali Al Samiri
(74) *Attorney, Agent, or Firm* — JCIPRNET

(57) ABSTRACT

A vapor chamber structure includes a first flexible substrate, a second flexible substrate, a spacer, a flexible sealing member, and a working fluid. The first flexible substrate includes a first organic material layer, a first copper foil layer, and a first capillary structure layer. The second flexible substrate includes a second organic material layer, a second copper foil layer, and a second capillary structure layer. The first copper foil layer, the first capillary structure layer, the spacer, the second copper foil layer, and the second capillary structure layer are retracted by a distance relative to the first and second organic material layers to form a space. The first and second organic material layers and the flexible sealing member define a sealed chamber. The working fluid is disposed in the sealed chamber and located among the first and second capillary structure layers and grooves of the spacer.

10 Claims, 5 Drawing Sheets

Related U.S. Application Data division of application No. 17/168,200, filed on Feb. 5, 2021, now abandoned, which is a continuation-in-part of application No. 17/017,702, filed on Sep. 11, 2020, now abandoned.

(60) Provisional application No. 63/528,657, filed on Jul. 25, 2023, provisional application No. 62/972,050, filed on Feb. 9, 2020.

(56) References Cited

U.S. PATENT DOCUMENTS

| | | | | |
|---|---|---|---|---|
| 2020/0326134 | A1* | 10/2020 | Chen | F28D 15/046 |
| 2021/0293485 | A1 | 9/2021 | Liu | |

FOREIGN PATENT DOCUMENTS

| | | |
|---|---|---|
| TW | I716932 | 1/2021 |
| TW | M620264 | 11/2021 |
| TW | 202321645 | 6/2023 |

* cited by examiner

VAPOR CHAMBER STRUCTURE AND MANUFACTURING METHOD THEREOF

CROSS-REFERENCE TO RELATED APPLICATION

This application is a continuation-in-part application of and claims the priority benefit of a prior U.S. application Ser. No. 17/983,396, filed on Nov. 9, 2022. The prior U.S. application Ser. No. 17/983,396 is a divisional application of and claims the priority benefit of a prior U.S. application Ser. No. 17/168,200, filed on Feb. 5, 2021, which is a continuation-in-part application of and claims the priority benefit of a prior U.S. application Ser. No. 17/017,702, filed on Sep. 11, 2020, which claims the priority benefit of a U.S. provisional application Ser. No. 62/972,050, filed on Feb. 9, 2020, and Taiwan application serial no. 109123680, filed on Jul. 14, 2020. The prior U.S. application Ser. No. 17/168,200 also claims the priority benefit of a Taiwan application serial no. 109138973, filed on Nov. 9, 2020. This application also claims the priority benefit of U.S. provisional application Ser. No. 63/528,657, filed on Jul. 25, 2023 and Taiwan application serial no. 112142742, filed on Nov. 7, 2023. The entirety of each of the above-mentioned patent applications is hereby incorporated by reference herein and made a part of this specification.

BACKGROUND

Technical Field

The disclosure relates to a thermally conductive structure and a manufacturing method thereof; in particular, the disclosure relates to a vapor chamber structure and a manufacturing method thereof.

Description of Related Art

Existing vapor chambers are mostly installed on an outer edge of an electronic system and between an electronic element or a circuit board and a cooling plate. Since the thickness of the vapor chambers are mostly above 1 mm, and the vapor chambers are not apt to be bent, it is difficult to place the vapor chambers in, for instance, a mobile phone shell, which poses a limitation to application ranges of the vapor chambers.

SUMMARY

The disclosure provides a vapor chamber structure which is bendable and of a small thickness. The disclosure further provides a manufacturing method for manufacturing the above-mentioned vapor chamber structure.

In an embodiment of the disclosure, a vapor chamber structure is provided, and the vapor chamber structure includes a first flexible substrate, a second flexible substrate, a spacer, a flexible sealing member, and a working fluid. The first flexible substrate includes a first polymer material layer, a first copper foil layer, and a first capillary structure layer, where the first copper foil layer is located between the first polymer material layer and the first capillary structure layer. The second flexible substrate includes a second polymer material layer, a second copper foil layer, and a second capillary structure layer, where the second copper foil layer is located between the second polymer material layer and the second capillary structure layer. At least one of the first polymer material layer and the second polymer material layer has at least one opening, and the at least one opening correspondingly exposes at least one of the first copper foil layer and the second copper foil layer. The spacer is sandwiched between the first capillary structure layer and the second capillary structure layer, and the spacer has a top surface, a bottom surface opposite to the top surface, and a plurality of grooves penetrating the spacer and connecting the top surface and the bottom surface, where the first copper foil layer, the first capillary structure layer, the spacer, the second copper foil layer, and the second capillary structure layer are retracted by a distance relative to the first polymer material layer and the second polymer material layer to form a space. The flexible sealing member seals the space, where the first copper foil layer, the second copper foil layer, and the flexible sealing member define a sealed chamber, and the first capillary structure layer, the second capillary structure layer, and the grooves are located in the sealed chamber. The working fluid is disposed in the sealed chamber, and the working fluid is located among the first capillary structure layer, the second capillary structure layer, and the grooves.

According to an embodiment of the disclosure, each of the first capillary structure layer and the second capillary structure layer includes a mesh structure layer, and a material of the mesh structure layer includes metal, alloy, stainless steel, ceramics, glass fiber, carbon, or an polymer plastic material.

According to an embodiment of the disclosure, materials of the first polymer material layer and the second polymer material layer respectively include a liquid crystal polymer (LCP), polyimide (PI), or silicone.

According to an embodiment of the disclosure, a material of the flexible sealing member includes an LCP, PI, or silicone.

According to an embodiment of the disclosure, the distance ranges from 0.5 cm to 1.5 cm.

According to an embodiment of the disclosure, the vapor chamber structure further includes an adhesive layer that is disposed in the space, where the flexible sealing member seals the space through the adhesive layer.

According to an embodiment of the disclosure, a material of the spacer includes stainless steel.

According to an embodiment of the disclosure, the working fluid includes water.

In an embodiment of the disclosure, a manufacturing method of a vapor chamber structure is provided, and the manufacturing method includes following steps. A first flexible base material and a second flexible base material are provided, where the first flexible base material includes a first polymer material layer and a first copper foil layer, and the second flexible base material includes a second polymer material layer and a second copper foil layer. A first capillary structure layer and a second capillary structure layer are formed on the first copper foil layer and the second copper foil layer, respectively, where the first copper foil layer is located between the first polymer material layer and the first capillary structure layer, the first polymer material layer, the first copper foil layer, and the first capillary structure layer define a first flexible substrate, the second copper foil layer is located between the second polymer material layer and the second capillary structure layer, and the second polymer material layer, the second copper foil layer, and the second capillary structure layer define a second flexible substrate. A spacer is sandwiched between the first capillary structure layer and the second capillary structure layer, wherein the first capillary structure layer, the spacer, and the second capillary structure layer define a chamber, the spacer has a top surface, a bottom surface opposite to the top surface, and a plurality of grooves penetrating the spacer and connecting the top surface and the bottom surface, and the first copper foil layer, the first capillary structure layer, the spacer, the second copper foil layer, and the second capillary structure layer are retracted by a distance relative to the first polymer material layer and the second polymer material layer to form a space. The chamber is filled with a working fluid, where the working fluid is located among the first capillary structure layer, the second capillary structure layer, and the grooves. A vacuuming process is performed on the chamber, and a flexible sealing member is formed to seal the space, where the first copper foil layer, the second copper foil layer, and the flexible sealing member define a sealed chamber, and the first capillary structure layer, the second capillary structure layer, and the grooves are located in the sealed chamber. A drilling process is performed on at least one of the first polymer material layer and the second polymer material layer to form at least one opening, and the at least one opening correspondingly exposes at least one of the first copper foil layer and the second copper foil layer.

According to an embodiment of the disclosure, the manufacturing method further includes providing an adhesive layer, where the flexible sealing member seals the space through the adhesive layer.

Accordingly, in the vapor chamber structure provided in one or more embodiments of this disclosure, the first flexible substrate includes the first polymer material layer, the first copper foil layer, and the first capillary structure layer, while the second flexible substrate includes the second polymer material layer, the second copper foil layer, and the second capillary structure layer. The spacer for the working fluid to pass through is arranged between the first capillary structure layer and the second capillary structure layer, at least one of the first polymer material layer and the second polymer material layer has at least one opening, and the at least one opening correspondingly exposes at least one of the first copper foil layer and the second copper foil layer. Through the above design, the vapor chamber structure provided in one or more embodiments of this disclosure is bendable and has a reduced thickness.

In order to make the features and advantages of the disclosure more comprehensible, the following specific embodiments are described in detail in connection with accompanying drawings.

DESCRIPTION OF THE EMBODIMENTS

Figure 1A:
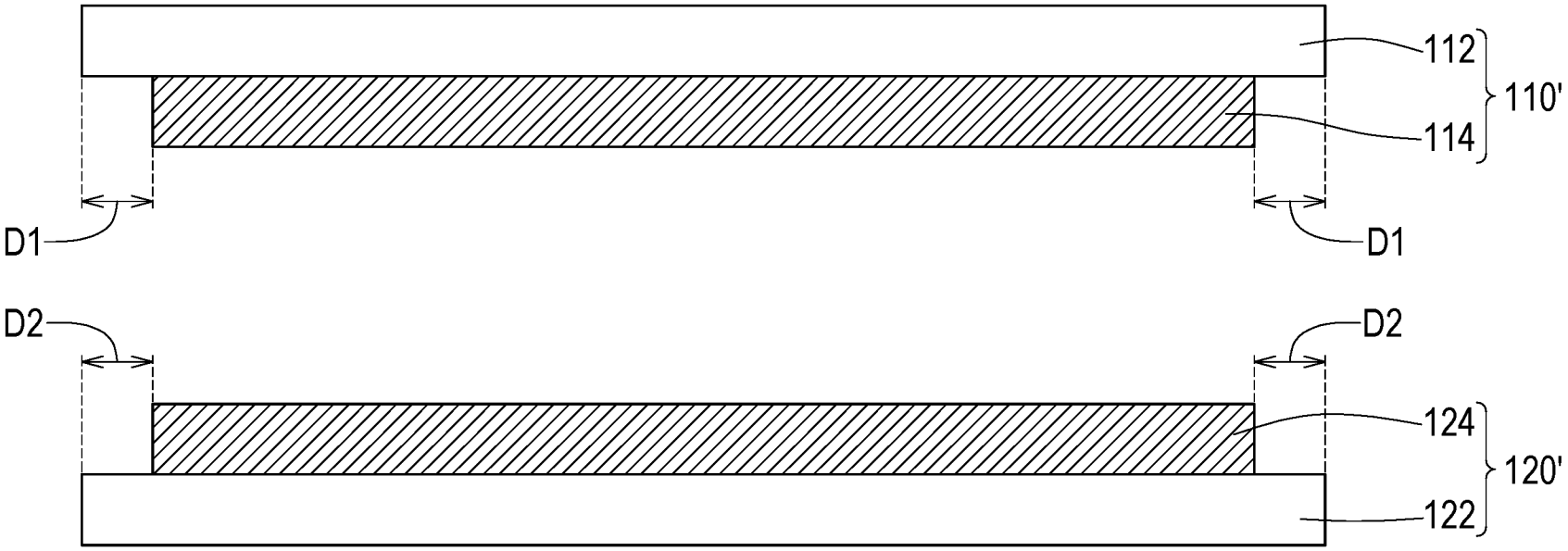
FIG. 1A to FIG. 1D are schematic cross-sectional views illustrating a manufacturing method of a vapor chamber structure according to an embodiment of the disclosure.

The embodiments provided in the disclosure are fully described below with reference to the drawings, and the drawings are considered as parts of the disclosure. It should be understood that the drawings are not drawn to scale. As a matter of fact, for clear descriptions, the dimension of respective features may be arbitrarily enlarged or reduced.

FIG. 1A to FIG. 1D are schematic cross-sectional views illustrating a manufacturing method of a vapor chamber structure according to an embodiment of the disclosure. FIG. 2 is a schematic three-dimensional view illustrating the spacer depicted in FIG. 1C. Regarding the manufacturing method of the vapor chamber structure provided in this embodiment, with reference to FIG. 1A, a first flexible base material 110' and a second flexible base material 120' are provided and are disposed opposite to each other. In detail, the first flexible base material 110' includes a first polymer material layer 112 and a first copper foil layer 114. The first copper foil layer 114 is located on the first polymer material layer 112 and retracted by a first distance D1 relative to the first polymer material layer 112. That is, the first copper foil layer 114 is smaller in size than the first polymer material layer 112. In an embodiment, the first distance D1, for instance, ranges from 0.5 cm to 1.5 cm. The second flexible base material 120' includes a second polymer material layer 122 and a second copper foil layer 124. The second copper foil layer 124 is located on the second polymer material layer 122 and retracted by a second distance D2 relative to the second polymer material layer 122. That is, the second copper foil layer 124 is smaller in size than the second polymer material layer 122. In an embodiment, the second distance D2, for instance, ranges from 0.5 cm to 1.5 cm.

Figure 2:
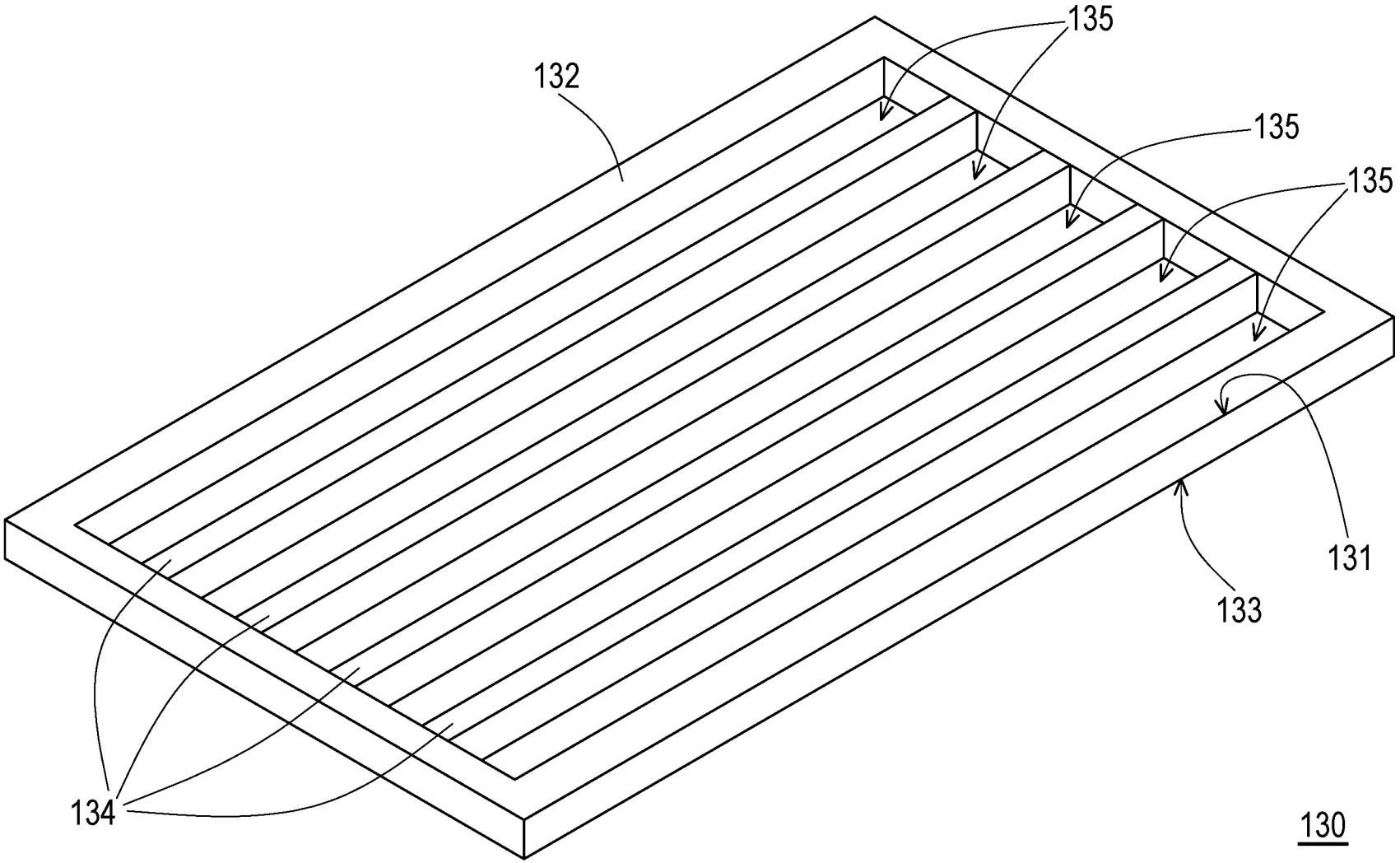
FIG. 2 is a schematic three-dimensional view illustrating the spacer depicted in FIG. 1C.

As shown in FIG. 1A, the first copper foil layer 112 of the first flexible base material 110' faces the second copper foil layer 122 of the second flexible base material 120'. In an embodiment, materials of the first polymer material layer 112 and the second polymer material layer 122 may include, for instance, a liquid crystal polymer (LCP), polyimide (PI), or silicone. A thickness of the first polymer material layer 112 and a thickness of the second polymer material layer 122 may, for instance, range from 15 micrometers to 100 micrometers. In an embodiment, the first distance D1 may be equal to the second distance D2.

Figure 1B:
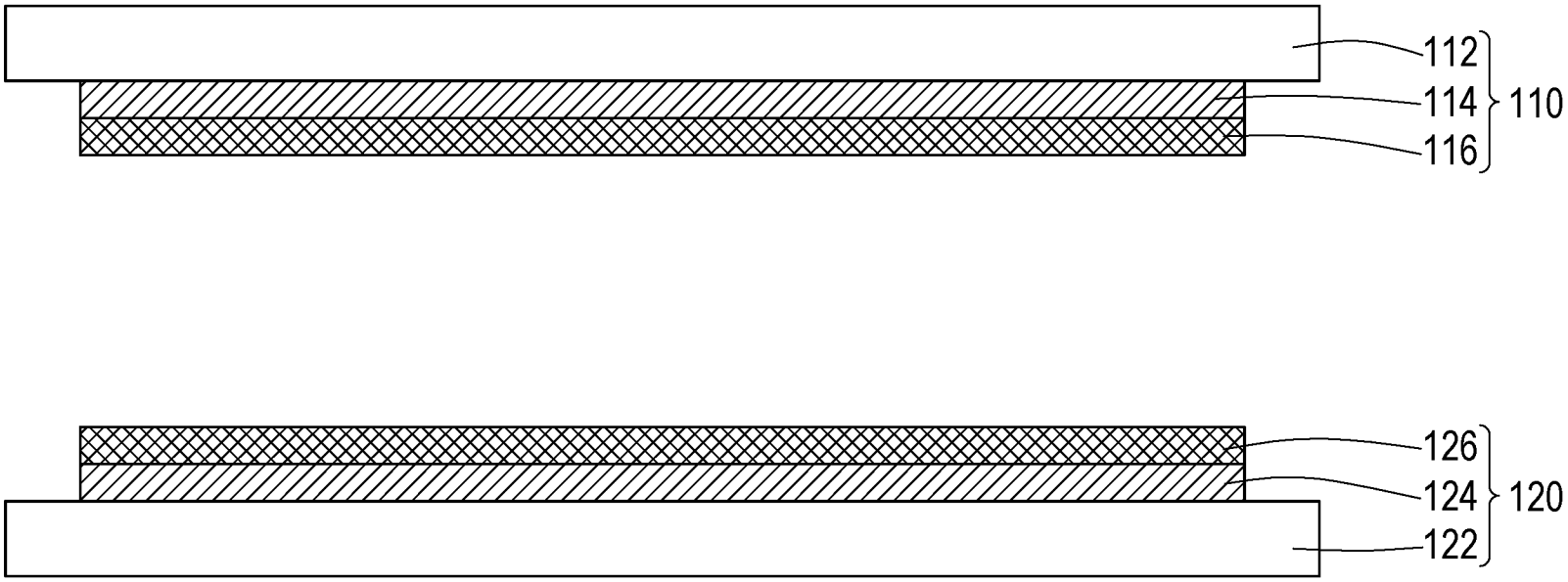

With reference to FIG. 1B, a first capillary structure layer 116 and a second capillary structure layer 126 are respectively formed on the first copper foil layer 114 and the second copper foil layer 124. The first copper foil layer 114 is located between the first polymer material layer 112 and the first capillary structure layer 116, and the first polymer material layer 112, the first copper foil layer 114, and the first capillary structure layer 116 define a first flexible substrate 110. A size of the first capillary structure layer 116 is the same as a size of the first copper foil layer 114, and a sum of a thickness of the first capillary structure layer 116 and a thickness of the first copper foil layer 114, for instance, ranges from 50 micrometers to 100 micrometers. The second copper foil layer 124 is located between the second polymer material layer 122 and the second capillary structure layer 126, and the second polymer material layer 122, the second copper foil layer 124, and the second capillary structure layer 126 define a second flexible substrate 120. A size of the second capillary structure layer 126 is the same as a size of the second copper foil layer 124, and a sum of a thickness of the second capillary structure layer 126 and a thickness of the second copper foil layer 124, for instance, ranges from 50 micrometers to 100 micrometers. In an embodiment, the first flexible substrate 110 and the second flexible substrate 120 may be, for instance, a flexible copper clad laminate (FCCL), respectively.

In an embodiment, the first capillary structure layer 116 and the second capillary structure layer 126 may be formed by etching the first copper foil layer 114 and the second copper foil layer 124, respectively. In another embodiment, the first capillary structure layer 116 and the second capillary structure layer 126 may also be formed by electroplating. In an embodiment, each of the first capillary structure layer 116 and the second capillary structure layer 126 may be, for instance, a mesh structure layer, where a material of the mesh structure layer may include metal, alloy, stainless steel, ceramics, glass fiber, carbon, or an polymer plastic material. In another embodiment, the first capillary structure layer 116 and the second capillary structure layer 126 may also be made of a porous medium, where a pore diameter of the porous medium ranges from 5 micrometers to 50 micrometers.

Figure 1C:
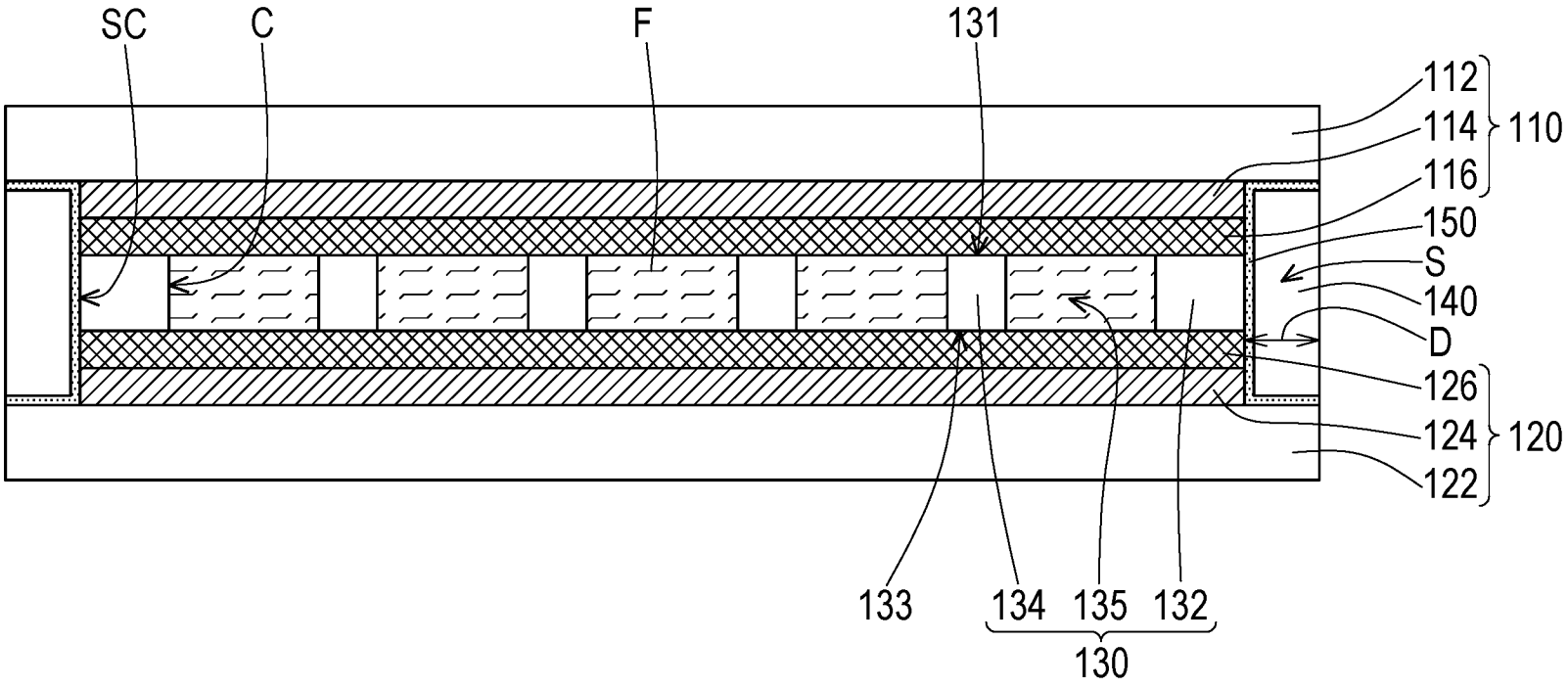

With reference to FIG. 1C and FIG. 2, a spacer 130 is sandwiched between the first capillary structure layer 116 and the second capillary structure layer 126, where the first capillary structure layer 116, the spacer 130, and the second capillary structure layer 126 define a chamber C. Specifically, the spacer 130 has a top surface 131 and a bottom surface 133 that are opposite to each other, and the spacer 130 also has a plurality of grooves 135 that penetrate the spacer 130 and connect the top surface 131 and the bottom surface 133. The first copper foil layer 114, the first capillary structure layer 116, the spacer 130, the second copper foil layer 124, and the second capillary structure layer 126 are retracted by a distance D relative to the first polymer material layer 112 and the second polymer material layer 122 to form a space S. Here, this distance D is equal to the first distance D1 or the second distance D2 in FIG. 1A; that is, the distance D ranges from 0.5 cm to 1.5 cm.

To be specific, in this embodiment, the spacer 130 provided in this embodiment may be implemented to include a ring-shaped frame 132 and a plurality of strip-shaped spacer parts 134 located in the ring-shaped frame 132 and connected to the ring-shaped frame 132, where the strip-shaped spacer parts 134 and the ring-shaped frame 132 define the grooves 135. In an embodiment, the ring-shaped frame 132 and the strip-shaped spacer parts 134 may be an integrally formed structure. In an embodiment, a material of the spacer 130 includes, for instance, stainless steel. In an embodiment, a width of the ring-shaped frame 132 may be greater than or equal to a width of the strip-shaped spacer parts 134.

With reference to FIG. 1C, the chamber C is filled with a working fluid F, and the working fluid F is located among the first capillary structure layer 116, the second capillary structure layer 126, and the grooves 135. The first capillary structure layer 116 and the second capillary structure layer 126 may transport the working fluid F through a capillary action; that is, the first capillary structure layer 116 and the second capillary structure layer 126 may provide capillary channels for a liquid fluid, while the grooves 135 of the spacer 130 may provide channels for a vapor fluid. In an embodiment, the working fluid F includes, for instance, water.

With reference to FIG. 1C, a vacuuming process is performed on the chamber C, and a flexible sealing member 140 is formed and seals the space S. The first copper foil layer 114, the second copper foil layer 124, and the flexible sealing member 140 define a sealed chamber SC, and the first capillary structure layer 116, the second capillary structure layer 126, and the grooves 135 are located in the sealed chamber SC. In an embodiment, before the vacuuming process is performed on the chamber C, an adhesive layer 150 may be provided, where the adhesive layer 150 may be adhered into the space S. In other words, the adhesive layer 150 may be adhered to a protruding part of the first polymer material layer 112 relative to the first copper foil layer 114, a sidewall of the first copper foil layer 114, a sidewall of the first capillary structure layer 116, a sidewall of the ring-shaped frame 132 of the spacer 130, a sidewall of the second capillary structure layer 126, a sidewall of the second copper foil layer 124, and a protruding part of the second polymer material layer 122 relative to the second copper foil layer 124, and the flexible sealing member 140 may seal the space S through the adhesive layer 150. In an embodiment, a material of the flexible sealing member 140 may include, for instance, an LCP, PI, or silicone.

Figure 1D:
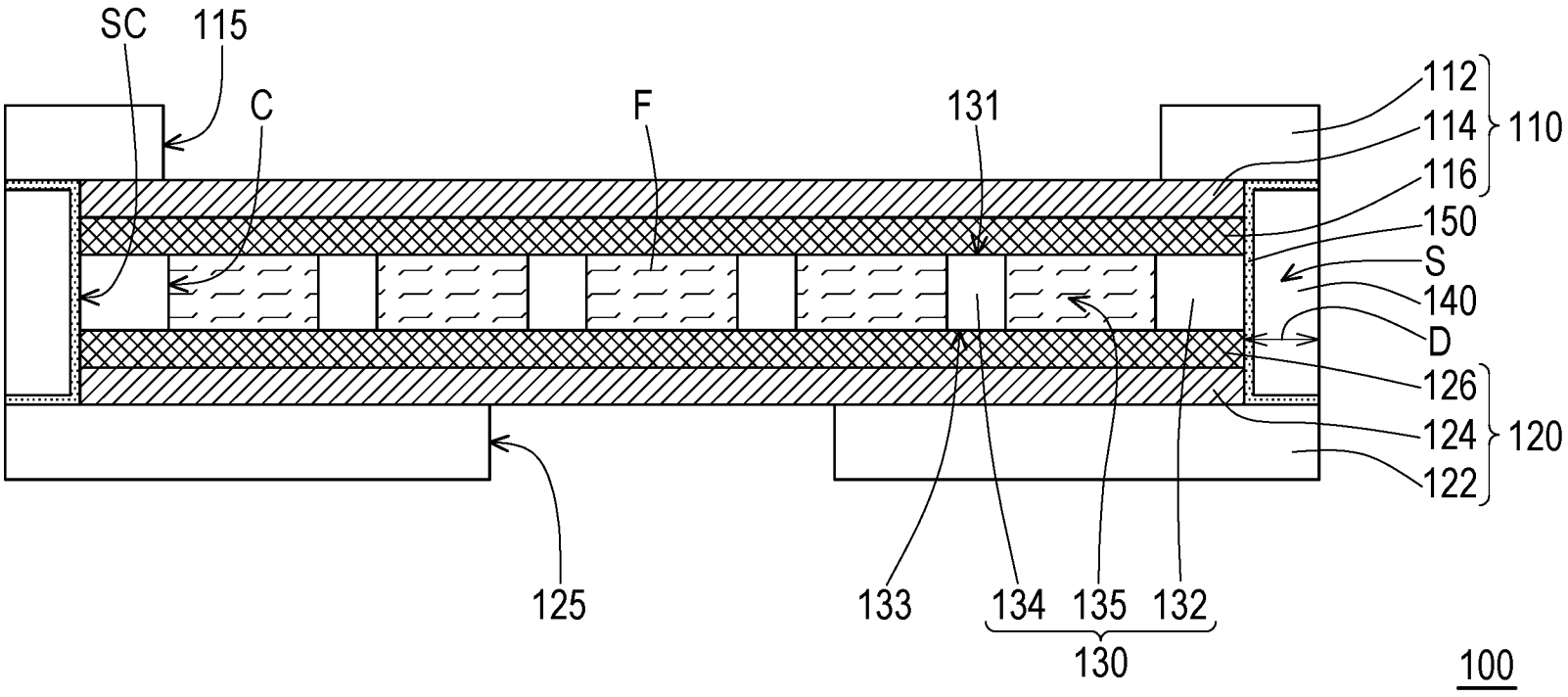

With reference to FIG. 1D, a drilling process is performed on at least one of the first polymer material layer 112 and the second polymer material layer 122 to form at least one opening, and the at least one opening correspondingly exposes at least one of the first copper foil layer 122 and the second copper foil layer 124. Here, for instance, openings 115 and 125 are respectively formed on the first polymer material layer 112 and the second polymer material layer 122 through laser ablation, etching, or any other appropriate method, and the openings 115 and 125 correspondingly expose a part of the first copper foil layer 114 and a part of the second copper foil layer 124 for heat dissipation. In an embodiment, an aperture of the opening 115 may be greater than or equal to an aperture of the opening 125. In an embodiment, a heat source and/or a radiator may be selectively disposed in the opening 115 and/or the opening 125 to directly contact the part of the first copper foil layer 114 and/or the part of the second copper foil layer 124 exposed by the openings 115 and 125. At this point, the fabrication of the vapor chamber structure 100 is completed.

Structurally, as shown in FIG. 1D, according to this embodiment, the vapor chamber structure 100 includes the first flexible substrate 110, the second flexible substrate 120, the spacer 130, the flexible sealing member 140, and the working fluid F. The first flexible substrate 110 includes the first polymer material layer 112, the first copper foil layer 114, and the first capillary structure layer 116, where the first copper foil layer 114 is located between the first polymer material layer 112 and the first capillary structure layer 116. The second flexible substrate 120 includes the second polymer material layer 122, the second copper foil layer 124, and the second capillary structure layer 126, where the second copper foil layer 124 is located between the second polymer material layer 122 and the second capillary structure layer 126. At least one of the first polymer material layer 112 and the second polymer material layer 122 has at least one of the openings 115 and 125, and the at least one of the openings 115 and 125 correspondingly exposes at least one of the first copper foil layer 114 and the second copper foil layer 124. The spacer 130 is sandwiched between the first capillary structure layer 116 and the second capillary structure layer 126. The spacer 130 has the top surface 131, the bottom surface 133 opposite thereto, and the grooves 135 that penetrate the spacer 130 and connect the top surface 131 and the bottom surface 133. The first copper foil layer 114, the first capillary structure layer 116, the spacer 130, the second copper foil layer 124, and the second capillary structure layer 126 are retracted by the distance D relative to the first polymer material layer 112 and the second polymer material layer 122 to form the space S. The flexible sealing member 140 seals the space S. The first copper foil layer 114, the second copper foil layer 124, and the flexible sealing member 140 define the sealed chamber SC, and the first capillary structure layer 116, the second capillary structure layer 126, and the grooves 135 are located in the sealed chamber SC. The working fluid F is disposed within the sealed chamber SC and located among the first capillary structure layer 116, the second capillary structure layer 126, and the grooves 135. In addition, the vapor chamber structure 100 provided in this embodiment further includes the adhesive layer 150, which is disposed in the spacer S, where the flexible sealing member 140 may seal the space S through the adhesive layer 150. To sum up, in the vapor chamber structure provided in one or more embodiments of disclosure, the first flexible substrate includes the first polymer material layer, the first copper foil layer, and the first capillary structure layer, while the second flexible substrate includes the second polymer material layer, the second copper foil layer, and the second capillary structure layer. The spacer for the working fluid to pass through is arranged between the first capillary structure layer and the second capillary structure layer, at least one of the first polymer material layer and the second polymer material layer has at least one opening, and the at least one opening correspondingly exposes at least one of the first copper foil layer and the second copper foil layer. Through the above design, the vapor chamber structure provided in one or more embodiments of this disclosure is bendable and has a reduced thickness.

Although the disclosure has been disclosed through the above embodiments, the embodiments are not intended to limit the disclosure. Those skilled in the art may make some changes and modifications without departing from the spirit and scope of the disclosure. Therefore, the scope of the disclosure shall be defined by the attached claims.

What is claimed is:

1. A vapor chamber structure, comprising:

a first flexible substrate, comprising a first polymer material layer, a first copper foil layer, and a first capillary structure layer, wherein the first copper foil layer is located between the first organic material layer and the first capillary structure layer;

a second flexible substrate, comprising a second polymer material layer, a second copper foil layer, and a second capillary structure layer, wherein the second copper foil layer is located between the second polymer material layer and the second capillary structure layer, at least one of the first polymer material layer and the second polymer material layer has at least one opening, and the at least one opening correspondingly exposes at least one of the first copper foil layer and the second copper foil layer;

a spacer, sandwiched between the first capillary structure layer and the second capillary structure layer and having a top surface, a bottom surface opposite to the top surface, and a plurality of grooves penetrating the spacer and connecting the top surface and the bottom surface, wherein the first copper foil layer, the first capillary structure layer, the spacer, the second copper foil layer, and the second capillary structure layer are retracted by a distance relative to the first polymer material layer and the second polymer material layer to form a space;

a flexible sealing member, sealing the space, wherein the first copper foil layer, the second copper foil layer, and the flexible sealing member define a sealed chamber, and the first capillary structure layer, the second capillary structure layer, and the grooves are located in the sealed chamber; and a working fluid, disposed in the sealed chamber and located among the first capillary structure layer, the second capillary structure layer, and the grooves.

2. The vapor chamber structure according to claim 1, wherein each of the first capillary structure layer and the second capillary structure layer comprises a mesh structure layer, and a material of the mesh structure layer comprises metal, alloy, stainless steel, ceramics, glass fiber, carbon, or an polymer plastic material.

3. The vapor chamber structure according to claim 1, wherein materials of the first polymer material layer and the second polymer material layer respectively comprise a liquid crystal polymer, polyimide, or silicone.

4. The vapor chamber structure according to claim 1, wherein a material of the flexible sealing member comprises a liquid crystal polymer, polyimide, or silicone.

5. The vapor chamber structure according to claim 1, wherein the distance ranges from 0.5 cm to 1.5 cm.

6. The vapor chamber structure according to claim 1, further comprising:

an adhesive layer, disposed in the space, wherein the flexible sealing member seals the space through the adhesive layer.

7. The vapor chamber structure according to claim 1, wherein a material of the spacer comprises stainless steel.

8. The vapor chamber structure according to claim 1, wherein the working fluid comprises water.

9. A manufacturing method of a vapor chamber structure, comprising:

providing a first flexible base material and a second flexible base material, wherein the first flexible base material comprises a first polymer material layer and a first copper foil layer, and the second flexible base material comprises a second polymer material layer and a second copper foil layer;

forming a first capillary structure layer and a second capillary structure layer on the first copper foil layer and the second copper foil layer, respectively, wherein the first copper foil layer is located between the first polymer material layer and the first capillary structure layer, the first polymer material layer, the first copper foil layer, and the first capillary structure layer define a first flexible substrate, the second copper foil layer is located between the second polymer material layer and the second capillary structure layer, and the second polymer material layer, the second copper foil layer, and the second capillary structure layer define a second flexible substrate;

sandwiching a spacer between the first capillary structure layer and the second capillary structure layer, wherein the first capillary structure layer, the spacer, and the second capillary structure layer define a chamber, the spacer has a top surface, a bottom surface opposite to the top surface, and a plurality of grooves penetrating the spacer and connecting the top surface and the bottom surface, and the first copper foil layer, the first capillary structure layer, the spacer, the second copper foil layer, and the second capillary structure layer are retracted by a distance relative to the first polymer material layer and the second polymer material layer to form a space;

filling the chamber with a working fluid, wherein the working fluid is located among the first capillary structure layer, the second capillary structure layer, and the grooves;

performing a vacuuming process on the chamber, and forming a flexible sealing member to seal the space, wherein the first copper foil layer, the second copper foil layer, and the flexible sealing member define a sealed chamber, and the first capillary structure layer, the second capillary structure layer, and the grooves are located in the sealed chamber; and performing a drilling process on at least one of the first polymer material layer and the second polymer material layer to form at least one opening, the at least one opening correspondingly exposing at least one of the first copper foil layer and the second copper foil layer.

10. The manufacturing method of the vapor chamber structure according to claim 9, further comprising:

providing an adhesive layer, wherein the flexible sealing member seals the space through the adhesive layer.

* * * * *